US005988560A

United States Patent [19]

Hinz et al.

[11] Patent Number: 5,988,560

[45] Date of Patent: Nov. 23, 1999

[54] ROLL WINDING DEVICE AND PROCESS

[75] Inventors: Joachim Hinz, Kempen; Herbert Müller, Krefeld, both of Germany

[73] Assignee: Voith Sulzer Finishing GmbH, Krefeld, Germany

[21] Appl. No.: 09/110,246

[22] Filed: Jul. 6, 1998

[30] Foreign Application Priority Data

Jul. 10, 1997 [DE] Germany ..... 197 29 532

[51] Int. Cl.[6] ..... B65H 18/20

[52] U.S. Cl. ..... 242/541.7

[58] Field of Search ..... 242/541.4, 541.5, 242/541.6, 541.7, 547; 34/184, 186

[56] References Cited

U.S. PATENT DOCUMENTS

| | | | |
|---|---|---|---|
| 5,647,555 | 7/1997 | Conrad et al. | 242/547 |
| 5,848,760 | 12/1998 | Kruger et al. | 242/542 |

FOREIGN PATENT DOCUMENTS

| | | |
|---|---|---|
| 2124827 | 8/1993 | Canada . |
| 0695708 | 2/1996 | European Pat. Off. . |
| 92017916 | 5/1992 | Germany . |
| 4201815 | 7/1993 | Germany . |
| 4219415 | 12/1993 | Germany . |
| 4427877 | 3/1996 | Germany . |
| 19524905 | 1/1997 | Germany . |

*Primary Examiner*—John M. Jillions
*Attorney, Agent, or Firm*—Greenblum & Bernstein, P.L.C.

[57] ABSTRACT

Roll winding device and process for use, e.g., in a reel slitting device. The roll winding device includes a roll carrier device, a pneumatic pressure release device including a plurality of blow boxes having top sides with escape nozzles, and a rocker arm on which the blow boxes are mounted in articulated pairs. The blow boxes are swivelably adjustable on tilting axes that run parallel to a roll axis. The process includes positioning the blow boxes beneath a peripheral surface of a roll being wound on the winding machine and ejecting air through the escape nozzles in the blow boxes directed toward the peripheral surface to orient the top surface of the blow box substantially parallel to a tangent of the peripheral surface and to position the top surfaces of the blow boxes a substantially same distance from the peripheral surface. In this manner, the ejected air forms an air cushion under the roll.

24 Claims, 1 Drawing Sheet

ROLL WINDING DEVICE AND PROCESS

CROSS-REFERENCE TO RELATED APPLICATIONS

The present application claims priority under 35 U.S.C. § 119 of German Patent Application No. 197 29 532.0, filed on Jul. 10, 1997, the disclosure of which is expressly incorporated by reference herein in its entirety.

BACKGROUND OF THE INVENTION

1. Field of the Invention

The present invention relates to a roll winding device and process, e.g., for a reel slitting device, that includes a roll support device and a pneumatic pressure release device.

2. Discussion of Background Information

A roll winding device similar to the device generally discussed above is known, e.g., from DE 195 24 905 A1, for use with material webs, e.g., paper webs.

In one of the last manufacturing steps, paper webs are usually cut or slit into a desired widths or partial webs and wound into rolls before they are packed and delivered to consumers. In contrast to the reel-spools which are used during paper production, the cores upon which these rolls are wound have a relatively low stiffness and bearing capability, and are generally cardboard tubes. Thus, the paper rolls are normally supported by support rolls during winding. This is particularly true if the winding device is a carrier roll winder in which the roll lies on carrier rolls without additional holding forces being applied on the core. However, even with a back-up roll winder, in which additional holding devices are used to hold the roll at its core, the roll rests on the back-up roll. As the paper rolls become larger and heavier, the line force of the paper roll on the support roll or rolls become increasingly larger. Thus, the roll density is likewise increased, which may disadvantageously lead to damage to a support roll. To unburden the support rolls and to reduce the line force, pneumatic overpressure can be produced underneath the paper roll, so that the paper roll is resting, at least partially, on air cushions.

The above-described pneumatic overpressure procedure has been utilized in the art to unburden the support roll. However, due to the changing geometry of the paper roll, a relatively large amount of pressurized air is required. Nevertheless, due to the escape of the air, forming the air cushion solely using the pressurized air is difficult.

SUMMARY OF THE INVENTION

The present invention provides effective support of a web roll with lower air consumption than in the prior art.

The present invention provides a web roll winding device of the type generally discussed above that includes a pressure release device having a plurality of blow boxes with escape nozzles located on a top side of the blow boxes. In this manner, the blow boxes may be coupled in articulated pairs on a rocker arm so that they may be oriented, i.e., inclined, relative to a tilting axis arranged parallel to a roll axis.

If a rocker arm is coupled to an axial end of the blow boxes, then a corresponding rocker arm coupled to the other axial end of the blow boxes is provided to ensure the necessary support. In accordance with a particular embodiment of the present invention, an angle of inclination of the blow boxes may be automatically adjusted or adapted to the changing roll diameter during winding. At a beginning of the winding process, the web roll practically has only the diameter of the roll core, which is, e.g., between approximately 10 and 20 cm. Since the weight of the roll core is low, no noteworthy volume of air is necessary. The blow boxes, however, may be adjusted in this situation so that their top sides are sharply inclined relative to the horizontal plane. As the roll diameter increases, the inclination steadily decreases and may, in fact, decrease automatically in accordance with the increasing roll diameter. Thus, an opening between the top side of the blow boxes and a periphery of the paper roll may be automatically maintained to a relatively small thickness that may also be substantially uniform over the peripheral direction. Air emanating or ejected from the escape nozzles is directed against the periphery of the paper roll. Thus, only very small amounts of unused air escape. The injected air streams or jets are directed substantially perpendicular to the peripheral wall of the paper roll.

The escape nozzles may be preferably arranged symmetrically to a plane that is oriented substantially perpendicularly to a top surface of the blow box and that runs through the tilting axis of the blow box. In this manner, it is substantially guaranteed that the opening on both edges of the blow boxes to the peripheral surface of the web roll remain substantially the same along the peripheral direction of the roll. Moreover, if the opening at one edge should happen to increase, more air escapes, which decreases the pressure at the increased opening edge to lower than the pressure at the other edge. In this manner, the boxes will then swing back or rotate on the tilting axis until an equilibrium state is attained at both edges. Because of the symmetrical design of the boxes, a state of equilibrium may be attained when both edges are equally spaced from the periphery of the roll.

The escape nozzles (blast jets) may be advantageously arranged in at least two parallel rows that extend parallel to the tilting axis. This embodiment provides advantages in functional efficiency. For example, the parallel rows may be easily produced and controlled according to symmetry. Conversely, a "chaotic" hole pattern would require greater expense.

A center of gravity of the blow boxes preferably lies in the direction of gravity beneath the tilting axis. If the web roll is lifted, the blow boxes automatically swing into a position to maintain substantially the same distance gap between the top sides of the blow boxes and the peripheral surface of the web roll. If a new web roll is put on, the tilting angle of the blow boxes automatically adjusts itself at least by the application of pressure.

In an advantageous embodiment, a plurality of rocker arms may be coupled in articulated pairs on a rocker arm holder so that they may be inclined on a second tilting axis running parallel to the roll axis. This embodiment is particularly advantageous if the web roll diameters become larger and if it would be difficult for a single pair of blow boxes to produce the pressure necessary to support the larger web roll. However, the above-noted features of the present invention apply even when additional blow boxes and the additional tilting axis is utilized. That is, with a pair of blow boxes, both blow boxes are coupled to a rocker arm. In accordance with this alternative embodiment, two rocker arms with blow boxes may be coupled to a rocker arm carrier (holder) so that the rocker arms can be swiveled. Each blow box automatically positionally adjusts itself on its rocker arm and each rocker arm automatically positions itself on the rocker arm carrier so that the opening between the surface of the blow boxes and the peripheral surface of the web roll remains uniform. In accordance with the present invention, this advantage may be further extended in a cascade fashion to provide additional jets, e.g., two rocker arm carriers may be arranged in an articulated pair on another rocker arm, on a base carrier, or on a positionally adjustable carrier.

The blow boxes of each rocker arm are preferably symmetrically arranged relative to a plane perpendicular to the peripheral surface of the web roll and extending through the second tilting angle. This arrangement provides benefits similar to those discussed with respect to a rocker arm with an articulated pair. An equilibrium of forces may then result at the rocker arm carrier when the rocker arm carrier is in the desired position with the rocker arms coupled as articulated pairs and with the blow boxes coupled to the rocker arms as articulated pairs. In the event that deviation or movement of the blow boxes and/or rocker arms occur, resulting equilibrium of forces will automatically lead to a return of the system elements into a stable condition.

The blow boxes advantageously include a changeable working width. In particular, because the widths of the web roll change in accordance with the positioning of a reel slitter, if the working widths of the blow boxes can be altered, air leakage may be substantially limited to areas in which a roll is supported.

It is also advantageous that the blow boxes include closing elements for the escape nozzles. These closing elements are not simply utilized to change the working widths, blowing in areas in a middle of the axial extent of the blow boxes may be stopped through closure of the closing elements. This may be particularly advantageous if several rolls are to be wound simultaneously and arranged at a distance from each other. Such an arrangement of rolls is generally provided by the use of, e.g., reel slitters.

In an advantageous embodiment, the closing elements may be self-guided, relative to a cover of the top side, via a roll. Thus, the escape nozzles are released only if a roll is positioned over them, otherwise, the escape nozzles are maintained in a closed position. In an exemplary embodiment, back valves may be utilized in the escape nozzles so that a control pin that protrudes from the surface may open the valves. If a roll is being wound, the control pins are pressed inwardly under the roll, thereby opening the valves. Valves outside the width of the roll remain closed. Of course, other sensors are conceivable, e.g., light barriers, pressure sensors, and similar devices. However, in each instance, the closing elements are controlled only at a position where a roll is to be supported.

In this manner, it is advantageous that the closing elements are formed by plates located inside and adjacent to the wall forming the top side. This results in an automatic seal because the pressure within the interior of the blow boxes presses the plates against the wall, thus, closing the escape nozzles even more securely.

The present invention is directed to a roll winding device that includes a roll carrier device, a pneumatic pressure release device including a plurality of blow boxes having top sides with escape nozzles, and a rocker arm on which the blow boxes are mounted in articulated pairs. The blow boxes are swivelably adjustable on tilting axes that run parallel to a roll axis.

In accordance with another feature of the present invention, the escape nozzles may be arranged symmetrically to planes that are positioned substantially perpendicular to the top sides and that extend through the tilting axes.

In accordance with another feature of the present invention, the escape nozzles may be arranged in at least two parallel rows that are parallel to the tilting axis.

In accordance with another feature of the present invention, the blow boxes may have centers of gravity located below the tilting axes.

According to another feature of the present invention, the device may include a plurality of rocker arms and a rocker arm carrier. The plurality of rocker arms may be mounted for articulated movement on the rocker arm carrier, and may be swivelably adjustable on second tilting axes that run parallel to the roll axis. Further, the blow boxes associated with a respective rocker arm are symmetrically arranged to a plane extending through the second tilting axis.

In accordance with yet another feature of the present invention, the blow boxes may be adapted to change a working width.

In yet a further feature of the present invention, the blow boxes may include closing elements associated with the escape nozzles. Further, the closing element may be actuatable depending upon whether the escape nozzles are covered by a roll. The closing elements may include plates located inside the blow box adjacent to a wall forming the top side.

In accordance with another feature of the present invention, the blow boxes may be positionable to form a gap from a peripheral surface of the roll between approximately 0.3 to 1.2 mm, and preferably approximately 0.5 mm.

In accordance with another feature of the present invention, the device including an air supply coupled to the blow boxes. The air is supplied to the blow boxes at a pressure of between approximately 0.5 and 1.5 bar.

In accordance with another feature of the present invention, the device may be adapted for use in a reel slitting device.

In accordance with another feature of the present invention, the device includes rims extending substantially perpendicularly from the edges of the top sides.

The present invention is directed to a pressure release device for a winding machine that includes a plurality of blow boxes. Each blow box may include a top surface having a plurality of escape nozzles, a bearing member adapted for swivelably adjusting the blow box, and a center of gravity located below the bearing member.

In accordance with another feature of the present invention, the device includes a rocker arm coupled to two of the plurality of blow boxes. The rocker arm may include a tilting axis substantially equally spaced from each of the two blow boxes.

In accordance with another feature of the present invention, the device includes a plurality of rocker arms with each rocker arm being coupled to two of the plurality of blow boxes. The plurality of rocker arms include tilting axes substantially equally spaced from each of the two coupled blow boxes. The device also includes a rocker arm carrier coupled to two of the plurality of rocker arms and the rocker arm carrier includes a second tilting axis equally spaced midway between the plurality of rocker arms.

In accordance with another feature of the present invention, the device including a rim extending substantially perpendicularly from an edge of the top surface.

In accordance with another feature of the present invention, the escape nozzles may be arranged in two substantially parallel rows. The two rows may be arranged symmetrically to a plane that is oriented substantially perpendicular to the top surface and that extends through the bearing member.

In accordance with another feature of the present invention, the device includes shutters adapted to selectively open and close the escape nozzles. The shutters may be located within the blow box.

The present invention is also directed to a process for relieving pressure on carrier rolls in a winding machine. The winding machine includes blow boxes having top sides with escape nozzles, and the escape nozzles are arranged in two substantially parallel rows. The process includes positioning the blow boxes beneath a peripheral surface of a roll being wound on the winding machine and ejecting air through the escape nozzles in the blow boxes. The air ejected through the escape nozzles is directed toward the peripheral surface to orient the top surface of the blow box substantially parallel to a tangent of the peripheral surface, and to position the top surfaces of the blow boxes a substantially same distance from the peripheral surface. In this manner, the ejected air forms an air cushion under the roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention as described herein discusses winding a material web, e.g., a paper web, into finished rolls. However, it is noted that the present invention is not limited to paper webs, and that the features of the present invention may be utilized by the ordinarily skilled artisan with many other material webs and similar products.

Figure 1:
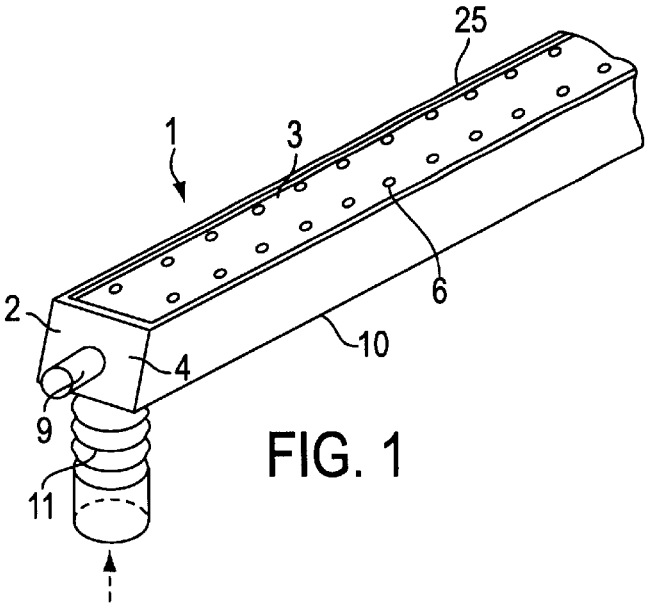
FIG. 1 illustrates a blow box.

FIG. 1 illustrates a blow box 1 that may be utilized, e.g., in a reel slitting device. The combination of blow box 1 in a reel slitting device will be explained later with reference to FIGS. 3 and 4. The blow box 1 exhibits a housing 2 with a top or upper side 3 and a front end 4. On top side 3, i.e., in a wall 5 forming top side 3, a plurality of escape nozzles 6 are positioned in, e.g., two parallel rows symmetrical to a plane 7 (see FIG. 2). Plane 7 is oriented substantially perpendicularly to surface 3 and extends through a tilting axis 8 that is formed by a swivel bolt 9. Swivel bolt 9 and tilting axis 8 are positioned above a center of gravity of blow box 1 so that, if blow box 1 is hung on swivel bolt 9, blow box 1 will adjust its orientation so that top side 3 is substantially horizontally oriented and escape nozzles 6 are directed substantially vertically upward. Top side 3 may be surrounded by a rim 25, e.g., a sealing lip, to form a pocket 26 that is adapted to receive the compressed air fed from chamber 12 through openings 6.

An air supply connection 11 is coupled to a lower side 10 of housing 2 so that air can pass into interior chamber 12 (see FIG. 2) of blow box 1, e.g., under a predetermined amount of pressure. The air can escape from interior chamber 12 through escape nozzles 6. The air enters pocket 26, where it forms an air cushion. During operation, pocket 26 is closed on top by paper roll 14 to define a gap h between blow box 1 and paper roll 14, and any air which escapes through gap h must be replaced via air supply connection 11.

The pressure built up within pressure pocket 26 may be between, e.g., approximately 0.5 and 1.5 bar, and gap h may be adjustable to a distance of between, e.g., approximately 0.3 and 1.2 mm, and preferably approximately 0.5 mm. The specific shape of nozzles 6 may be, e.g., round, elongated slits, or other geometric shapes.

Figure 3:
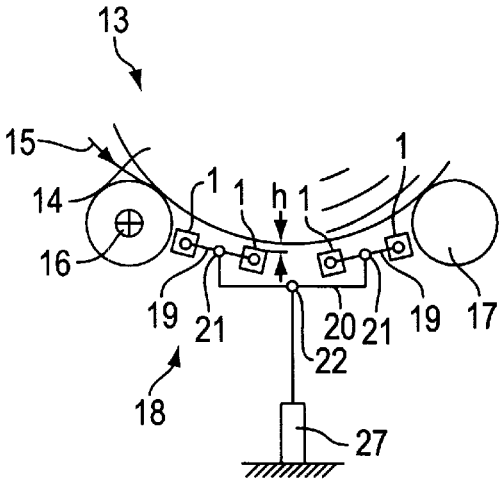
FIG. 3 illustrates a system of blow boxes with a small roll.
Figure 4:
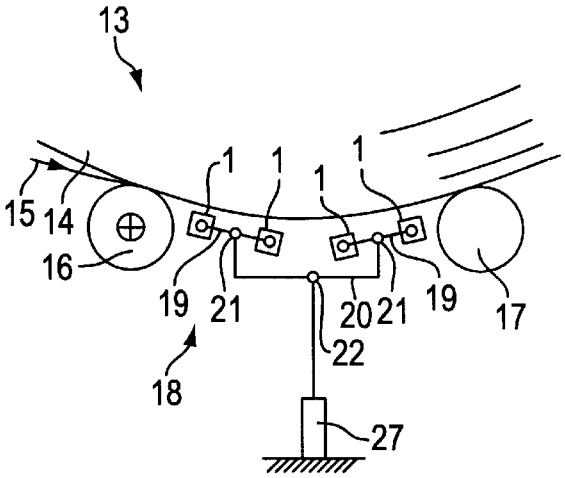
FIG. 4 illustrates the system of blow boxes with a large roll.

FIGS. 3 and 4 illustrate an advantageous arrangement of blow boxes 1 in a winding device 13 that winds a paper web 15 into a paper roll 14. Paper roll 14 may be positioned upon two carrier rolls 16 and 17, of which at least one is driven.

In the illustration of the FIGS. 3 and 4, if it is assumed that when the winding process is completed, carrier rolls 16 and 17 must be moved closer together to be able to accept an empty roll core to be wound. As soon as the roll has attained a certain size, i.e., diameter, carrier rolls 16 and 17 may be separated from each other to provide sufficient space for positioning a pressure release device 18. Carrier rolls 16 and 17 and/or pressure release device 18 may be movable in this manner. Pressure release device 18 may be adapted for vertical movement by being coupled to a piston/cylinder device 27. The movement of pressure release device 18 may also occur during the winding process, as will be further discussed below.

Pneumatic pressure release device 18, which is movable to a position between both carrier rolls 16 and 17, may include, e.g., four blow boxes 1, as illustrated in the exemplary illustrations. Blow boxes 1 may be coupled together in pairs on a rocker arm 19 that is mounted for articulated movement on swivel bolt 9. Tilting axis 8 of blow boxes 1 may be oriented substantially parallel to an axis of paper roll 14. Rocker arms 19, e.g., may be further mounted for articulated movement on a rocker arm carrier 20 along a second tilting axis 21. A further tilting axis 22 may be provided for the articulated movement of rocker arm carrier 20. Both second tilting axis 21 and further tilting axis 22 are oriented to run parallel to the axis of paper roll 14.

The positioning of each rocker arm 19 is symmetrical to second tilting axis 21 and further tilting axis 22, i.e., both blow boxes 1 of rocker arm 19 are equidistantly spaced from second tilting axis 21.

During a winding operation of paper roll 14, the diameter of paper roll 14, and, therefore, the weight of roll 14, increases. As the weight of paper roll 14 increases, the line forces applied by paper roll 14 on carrier rolls 16 and 17 also increase.

In order to unburden or reduce the loads on carriers 16 and 17, air is transported through air supply connection 11 into blow boxes 1 and escapes through escape nozzles 6. Because both blow boxes 1 are coupled for articulated movement on rocker arm 19; and rocker arm 19 is coupled for articulated movement on rocker arm carrier 20; and rocker arm carrier 20 is symmetrically positioned between both carrier rolls 16 and 17, a positional adjustment automatically results. In this manner, top surfaces 3 of blow boxes 1 are positioned a substantially equal distance from the periphery of paper roll 14, which is independent of the paper roll diameter. While the distances may vary with expanding roll diameters, during winding of roll 14, the distances of all blow boxes 1 are substantially equal.

An exemplary operation of an adjustment of the blow boxes 1 may occur in the following manner. For example, if a blow box 1 is not arranged substantially parallel to a tangent of the peripheral surface of paper roll 14, then a larger air opening results for a row of escape nozzles 6 having a lower flow resistance than the other row. Accordingly, a reaction force between paper roll 14 and blow box 1 is lower in the rows spaced farther away from paper roll 14 than the other row. Blow box 1 is swiveled on tilting axis 8 so that both rows of escape openings 6 are spaced substantially the same distance to the periphery of paper roll 14. This spacing occurs automatically, i.e., without exterior assistance or actuation. Similarly, every rocker arm 19, which swivels around second axes 21, will also adjust in a similar manner so that the forces on both blow boxes 1, i.e., mounted on opposite ends of rocker arm 19, are substantially equal. An equilibrium of force results in a motion of rocker arm 19 into a stable position, in which, as stated, the forces are equal. Further, the rocker arm carriers 20 may be arranged to swivel on a further tilting axis 22. With the aid of piston/cylinder unit 27, it is possible to always keep pressure release device 18 close enough to the circumference of paper roll 14 such that the air boxes 1 are only a small distance h from the periphery of paper roll 14 shown. In comparing FIGS. 3 and 4, the periphery of paper roll 14 moves upward as the diameter increases, i.e., paper roll 14 protrudes less far into the space between the two support rolls 16 and 17. Normally, this would lead to an increase in gap h, however, the increasing gap can be substantially avoided by tracking the pressure release device 18 with piston/cylinder unit 27.

Further, one of ordinary skill, utilizing the above disclosure, can utilize additional blow boxes 1, e.g., eight blow boxes 1 by mounting rocker arm carrier 20 for articulated movement on another carrier (not depicted in detail).

In accordance with the exemplary illustrations, it can be seen that, due to the uniform arrangement of the openings between blow box 1 and the periphery of roll 14, air expelled from escape nozzles 6 is used substantially exclusively for producing an air cushion to carry paper roll 14. Accordingly, losses of air through uneven openings and uneven distribution of forces onto paper roll 14 are largely avoided.

Figure 2:
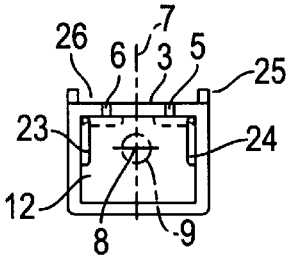
FIG. 2 illustrates a schematic cross section through the blow box.

As shown in FIG. 2, both rows of escape nozzles 6 may be provided with plate-like shutters 23 and 24, which may be swivelled from the solid line illustrated position that enables release of air through escape nozzles 6 into the dashed line illustrated position that covers escape nozzles 6. An individual shutter may be provided for each escape nozzle 6. Alternatively, shutters 23 and 24 may be provided for specified groups escape nozzles 6. In this manner, it is possible to limit air leakage from escape nozzles 6 to certain axial areas of blow box 1 because blow box 1 may be adapted to different roll widths and because the blow box may be utilized to accommodate several simultaneously wound rolls that are axially aligned but spaced at a predetermined distance from each other. Thus, because substantially no air is lost from areas that are not covered by a roll, the process conserves energy. Further, the air, which is applied under pressure, is substantially exclusively used for supporting paper rolls 14 on an air cushion.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roll winding device comprising:

a roll carrier device;

a pneumatic pressure release device including a plurality of blow boxes having top sides with escape nozzles; and a rocker arm on which the blow boxes are mounted in articulated pairs, the blow boxes being swivelably adjustable on tilting axes that run parallel to a roll axis.

2. The device in accordance with claim 1, the escape nozzles being arranged symmetrically to planes that are positioned substantially perpendicular to the top sides and that extend through the tilting axes.

3. The device in accordance with claim 2, the escape nozzles being arranged in at least two parallel rows that are parallel to the tilting axis.

4. The device in accordance with claim 1, the blow boxes having centers of gravity located below the tilting axes.

5. The device in accordance with claim 1, further comprising:

a plurality of rocker arms;

a rocker arm carrier;

the plurality of rocker arms being mounted for articulated movement on the rocker arm carrier, and being swivelably adjustable on second tilting axes that run parallel to the roll axis.

6. The device in accordance with claim 5, the blow boxes associated with a respective rocker arm being symmetrically arranged to a plane extending through the second tilting axis.

7. The device in accordance with claim 1, the blow boxes being swivelably orientable with a changing diameter of the web being wound.

8. The device in accordance with claim 1, the blow boxes comprising closing elements associated with the escape nozzles.

9. The device in accordance with claim 8, the closing element being actuatable depending upon whether the escape nozzles are covered by a roll.

10. The device in accordance with claim 8, the closing elements comprising plates located inside the blow box adjacent to a wall forming the top side.

11. The device in accordance with claim 1, the blow boxes being positionable to form a gap from a peripheral surface of the roll between approximately 0.3 to 1.2 mm.

12. The device in accordance with claim 1, the gap being approximately 0.5 mm.

13. The device in accordance with claim 1, further comprising an air supply coupled to the blow boxes, wherein air is supplied to the blow boxes at a pressure of between approximately 0.5 and 1.5 bar.

14. The device in accordance with claim 1, further comprising rims extending substantially perpendicularly from the edges of the top sides.

15. A reel slitting device that includes a roll winding device and the roll winding device comprising:

a roll carrier device;

a pneumatic pressure release device including a plurality of blow boxes having top sides with escape nozzles; and a rocker arm on which the blow boxes are mounted in articulated pairs, the blow boxes being swivelably adjustable on tilting axes that run parallel to a roll axis.

16. A pressure release device for a winding machine comprising:

a plurality of blow boxes, and each blow box including:

a top surface having a plurality of escape nozzles;

a bearing member adapted for swivelably adjusting the blow box; and a center of gravity located below the bearing member.

17. The pressure release device in accordance with claim 16, further comprising:

a rocker arm coupled to two of the plurality of blow boxes;

the rocker arm comprising a tilting axis substantially equally spaced from each of the two blow boxes.

18. The pressure release device in accordance with claim 16, further comprising:

a plurality of rocker arms, each rocker arm coupled to two of the plurality of blow boxes;

the plurality of rocker arms comprising tilting axes substantially equally spaced from each of the two coupled blow boxes;

a rocker arm carrier coupled to two of the plurality of rocker arms; and the rocker arm carrier comprising a second tilting axis equally spaced between the plurality of rocker arms.

19. The pressure release device in accordance with claim 16, further comprising a rim extending substantially perpendicularly from an edge of the top surface.

20. The pressure release device in accordance with claim 16, the escape nozzles being arranged in two substantially parallel rows.

21. The pressure release device in accordance with claim 20, the two rows being arranged symmetrically to a plane that is oriented substantially perpendicular to the top surface and that extends through the bearing member.

22. The pressure release device in accordance with claim 16, further comprising shutters adapted to selectively open and close the escape nozzles.

23. The pressure release device in accordance with claim 22, the shutters being located within the blow box.

24. A process for relieving pressure on carrier rolls in a winding machine, the winding machine including blow boxes having top sides with escape nozzles, the escape nozzles arranged in two substantially parallel rows, the process comprising:

positioning the blow boxes beneath a peripheral surface of a roll being wound on the winding machine; and ejecting air through the escape nozzles in the blow boxes directed toward the peripheral surface to orient the top surface of the blow box substantially parallel to a tangent of the peripheral surface and to position the top surfaces of the blow boxes a substantially same distance from the peripheral surface, whereby the ejected air forms an air cushion under the roll.

* * * * *